United States Patent [19]

Quan et al.

[11] 4,317,506

[45] Mar. 2, 1982

[54] ELEVATOR SYSTEM

[75] Inventors: Wing C. Quan, Waldwick; Richard H. Ludwig, West Caldwell, both of N.J.

[73] Assignee: Westinghouse Electric Corp., Pittsburgh, Pa.

[21] Appl. No.: 158,106

[22] Filed: Jun. 10, 1980

[51] Int. Cl.[3] ..... B66B 5/02

[52] U.S. Cl. ..... 187/29 R

[58] Field of Search ..... 187/29; 340/19, 21

[56] References Cited

U.S. PATENT DOCUMENTS

| | | | |
|---|---|---|---|
| 2,875,853 | 3/1959 | Borden et al. | 187/29 |
| 2,969,128 | 1/1961 | Jones et al. | 187/29 |
| 3,414,088 | 12/1968 | Bruns et al. | 187/29 |
| 3,592,296 | 7/1971 | Senn | 187/29 |
| 3,773,146 | 11/1973 | Dixon, Jr. et al. | 187/29 |
| 4,009,766 | 3/1977 | Satoh | 187/29 |
| 4,124,103 | 11/1978 | Otto et al. | 187/29 |
| 4,141,435 | 2/1979 | Satoh | 187/29 |
| 4,142,609 | 3/1979 | Tachino | 187/29 |

*Primary Examiner*—J. V. Truhe
*Assistant Examiner*—W. E. Duncanson, Jr.
*Attorney, Agent, or Firm*—D. R. Lackey

[57] ABSTRACT

An elevator system having a notching floor selector which is notched or advanced by notching signals developed as the elevator car moves through the hoistway, to cause the selector to store information relative to the actual position of the elevator car. The notching signals also actuate first and second counters, one of which operates a non-volatile memory. The memory count is compared with the count on the remaining counter, and when they are not equal a reset operation is initiated which includes resetting the notching floor selector and counters to represent a predetermined terminal floor, and the generation of auxiliary notching signals, all without moving the elevator car. When the memory and counter have the same count, the auxiliary notching signals are terminated, and the floor selector system is back in synchronism with the actual position of the elevator car.

8 Claims, 7 Drawing Figures

ELEVATOR SYSTEM

BACKGROUND OF THE INVENTION

1. Field of the Invention

The invention relates in general to elevator systems, and more specifically to elevator systems which use a notching type floor selector.

2. Description of the Prior Art

While the floor selectors of many elevator systems are now of the solid state type, a large number of the slower speed elevator systems still utilize notching type floor selectors which develop notching signals as the elevator car travels through the hoistway. These notching signals update the floor selector by picking up and dropping out certain electromechanical relays. The energized relay indicates the exact position of the elevator car in the hoistway when it is standing stationary at a floor of the associated building, and it indicates the next floor at which the moving elevator car can make a normal stop. Each time the moving elevator car notches into the next floor, the new floor registered or stored in selector is compared with the registered calls for elevator service. Thus, when the floor selector notches into a relay associated with a floor for which there is a call for service, appropriate preparation for slowdown and stopping at this floor is initiated.

If the electrical power to the floor selector should be interrupted, or the floor selector gets out of step with the actual car position for any other reason, the operation of the elevator car will be incorrect, degrading the level of service. Thus, it is common to employ an initialization procedure following power turn-on which involves causing the elevator car to travel in a predetermined direction to a terminal floor, with the floor selector then being set to correspond to this terminal floor. If the floor selector should get out of step for a reason other than power failure it will also be corrected at a terminal floor, as it is common to reset the floor selector each time the elevator car arrives at a terminal floor. Other prior art arrangements utilize such expedients as coded indicia in the hoistway at each floor and appropriate "readers" of the indicia on the elevator car; or, batteries for powering car position memory circuits during a power outage.

It would be desirable to be able to monitor and correctly reset an out-of-step notching floor selector without requiring the elevator car to move to a predetermined reset floor, without requiring coded indicia in the hoistway and code readers on the car, and without requiring batteries of other auxiliary power supplies.

SUMMARY OF THE INVENTION

Briefly, the present invention is a new and improved elevator system including an elevator car mounted in a building to serve the floors therein, and electrical control for operating the elevator car. The electrical control includes a notching type floor selector which is notched or stepped in response to notching signals developed in response to movement of the elevator car in the hoistway. First and second counters are also incremented or decremented by the notching signals, with the counters always having a count which represent the current floor stored in the notching floor selector. A non-volatile memory stores the latest count of the first counter, and this memorized count is continuously compared with the count of the second counter by a comparator. If the power supply is interrupted, the notching floor selector will lose track of the car position, as will the first and second counters. This fact is immediately noted upon return of the power by the comparator. When the comparator detects this out-of-step condition, a resetting procedure is immediately initiated, which includes resetting the floor selector and counters to represent a predetermined terminal floor, and generating auxiliary notching signals for the floor selector and counters, all without movement of the elevator car. When the comparator detects that the count of the second counter is equal to the memorized count, the system is resynchronized and ready for service.

BRIEF DESCRIPTION OF THE DRAWINGS

The invention may be better understood and further advantages and uses thereof more readily apparent, when considered in view of the following detailed description of exemplary embodiments, taken with the accompanying drawings, in which.

DESCRIPTION OF PREFERRED EMBODIMENTS

Figure 1:
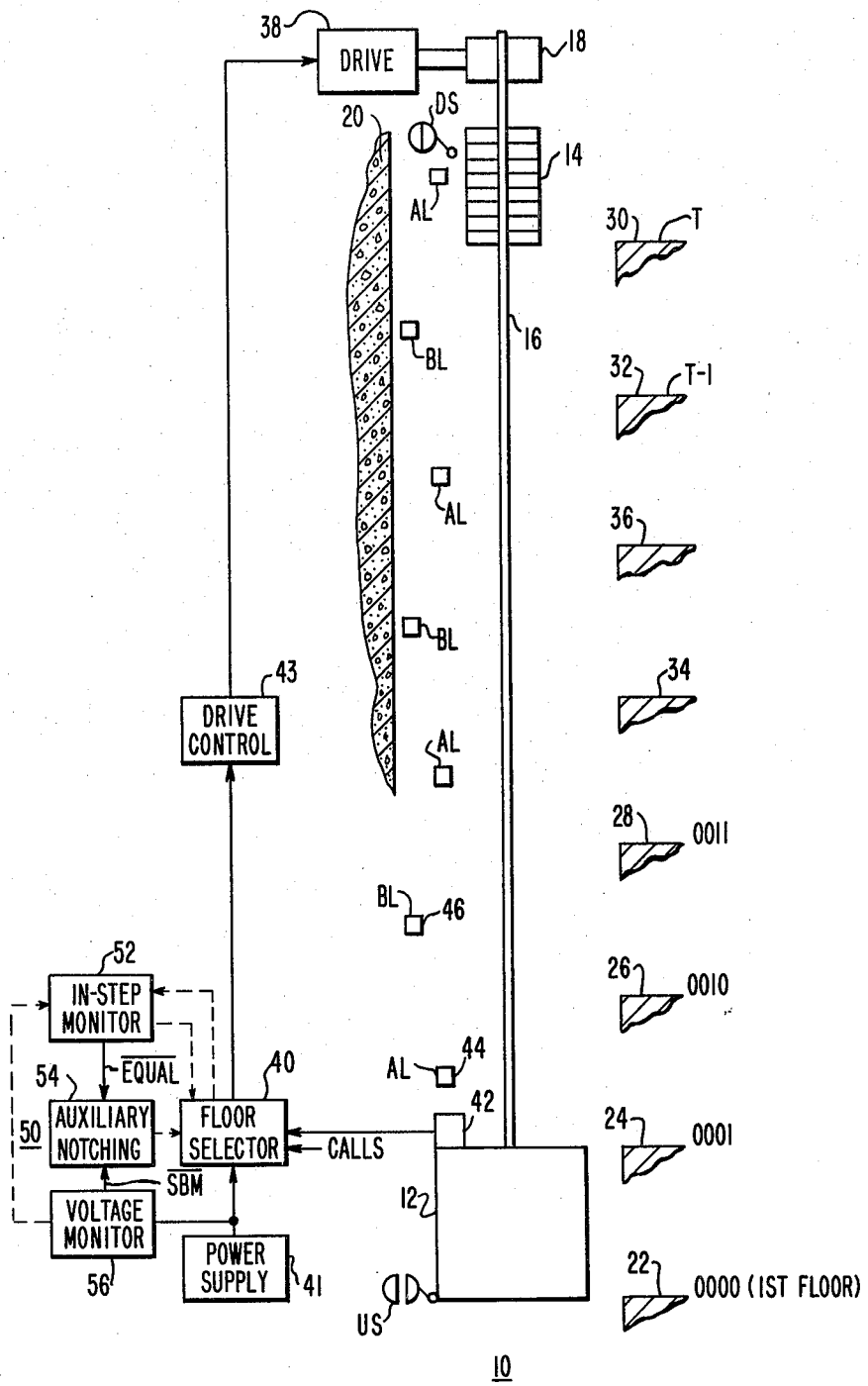
FIG. 1 is a partially schematic and partially block diagram of an elevator system constructed according to the teachings of the invention.

Referring now to the drawings, and to FIG. 1 in particular, there is shown in elevator system 10 of the traction type which is constructed according to the teachings of the invention. Elevator system 10 includes an elevator car 12 connected to a counterweight 14 via a suitable roping arrangement 16 which is reeved over a traction sheave 18. The elevator car 12 is suspended in the hatch or hoistway 20 of a structure or building to serve a plurality of landings or floors therein. For purposes of example, the lowest four floors, referenced 22, 24, 26 and 28, and the two uppermost floors, referenced 30 and 32, are illustrated, along with an intermediate floor 34, which represents all of the odd numbered intermediate floors, and an intermediate floor 36 which represents all of the even numbered intermediate floors. The lowest floor has the binary address 0000, and the floors are then numbered upwardly 0001, 0010, etc., using the number of bits in each address which are required to express the number or address of the uppermost floor in binary.

The traction sheave 18 is driven by a suitable drive 38, such as AC or DC motor connected directly to the traction sheave, or to a suitable gear arrangement.

A notching or stepping type floor selector 40, which includes an electrical power supply 41, controls the elevator car 12. The floor selector 40 keeps track of the position of the elevator car 12 in the building and the calls for elevator service, and it generates the necessary signals for drive control 43 to start the elevator car and to stop it at the appropriate floors.

Signals for notching or advancing floor selector 40 may be provided by a suitable indicia in the hoistway which is detected by a detector mounted on the elevator car. For example, floor selector 40 may be stepped or notched in response to indicators AL and BL disposed in the hoistway. While the invention is not limited to this arrangement for detecting car movement, it is a simple, low cost arrangement which is completely suitable for car speeds up to about 500 feet per minute. The indicia or hatch-mounted indicators may be cams for operating mechanical switches carried by the car; or, in order to eliminate the noise of such mechanical switches, permanent magnets and reed switches may be used in any desirable detector combination. The mechanical switches, or reed switches, are mounted on the elevator car 12 in a control panel shown generally at 42. The indicators AL and BL are disposed in different vertical lanes in the hoistway. When an AL indicator has been detected while traveling in a predetermined direction, the selector then enables a BL indicator to be detected, and when a BL indicator has been detected, the selector then enables an AL indicator to be detected, etc., in order to prevent contact bounce from falsely notching the selector. If the elevator car 12 is at the first floor (binary address 0000), when it starts to move upwardly, it will be set to detect an AL indicator in the AL lane, which it will do almost immediately, detecting AL indicator 44. The resulting detection of the AL indicator 44 is used to advance or notch floor selector 40 to indicate that the elevator car is at the second floor (binary address 0001). When the elevator car leaves the second floor, the BL indicator 46 in the BL lane is detected which notches the floor selector to the third floor (binary address 0010). If the elevator car should reverse at the third floor and start to travel downwardly, BL indicator 46 would notch the floor selector to the second floor, and when the elevator car leaves the second floor, the AL indicator 44 will notch the floor selector into the first floor.

Slowdown cams and leveling cams (not shown) are also disposed in the hoistway. When the floor selector 40 decides that a stop is to be made at a floor, and the car is near the proper slowdown point, it will generate a signal which enables the slowdown and leveling cams to be detected.

Suitable detectors are actuated when the elevator car 12 is located at either terminal floor. For example, a switch US may be actuated to its open position when car 12 is at the lowest floor 22, and a switch DS may be actuated to its open position when elevator car 12 is at the highest floor 30.

In addition to the conventional elevator control, elevator system 10 includes a monitoring means 50 for floor selector 40, with the monitoring means 50 being constructed according to the teachings of the invention. Monitoring means 50 includes an in-step monitor 52, an auxiliary notching function 54, and a power supply or voltage monitor 56 for monitoring the power supply 41. As will be hereinafter described in detail, monitor 52 detects an out-of-step condition and causes a signal $\overline{\text{EQUAL}}$ to go from the logic zero to the logic one level. This may be used as the trigger for the resynchronizing operation. In a preferred embodiment of the invention, the voltage monitor 56 detects when an interruption has occurred in the power supply 41 by providing a signal $\overline{\text{SBM}}$ which goes from a logic zero to a logic one level, with both a high signal $\overline{\text{EQUAL}}$ and a high signal $\overline{\text{SBM}}$ being required to trigger the in-step monitor 52. The in-step monitor 52 resets the floor selector 40 to a predetermined terminal floor, by providing an up reset signal which results in setting it to the lowest floor 22, or a down reset signal which results in resetting the selector to the uppermost floor 30. The terminal floor selected depends upon the travel direction of the elevator car at the time of power interruption. The auxiliary notching function 54 generates pseudo or auxiliary notching signals which notch the floor selector 40 until the in-step monitor 52 indicates the floor selector 40 is in-step with the actual position of the elevator car 12, i.e., signal $\overline{\text{EQUAL}}$ goes low.

Figure 2:
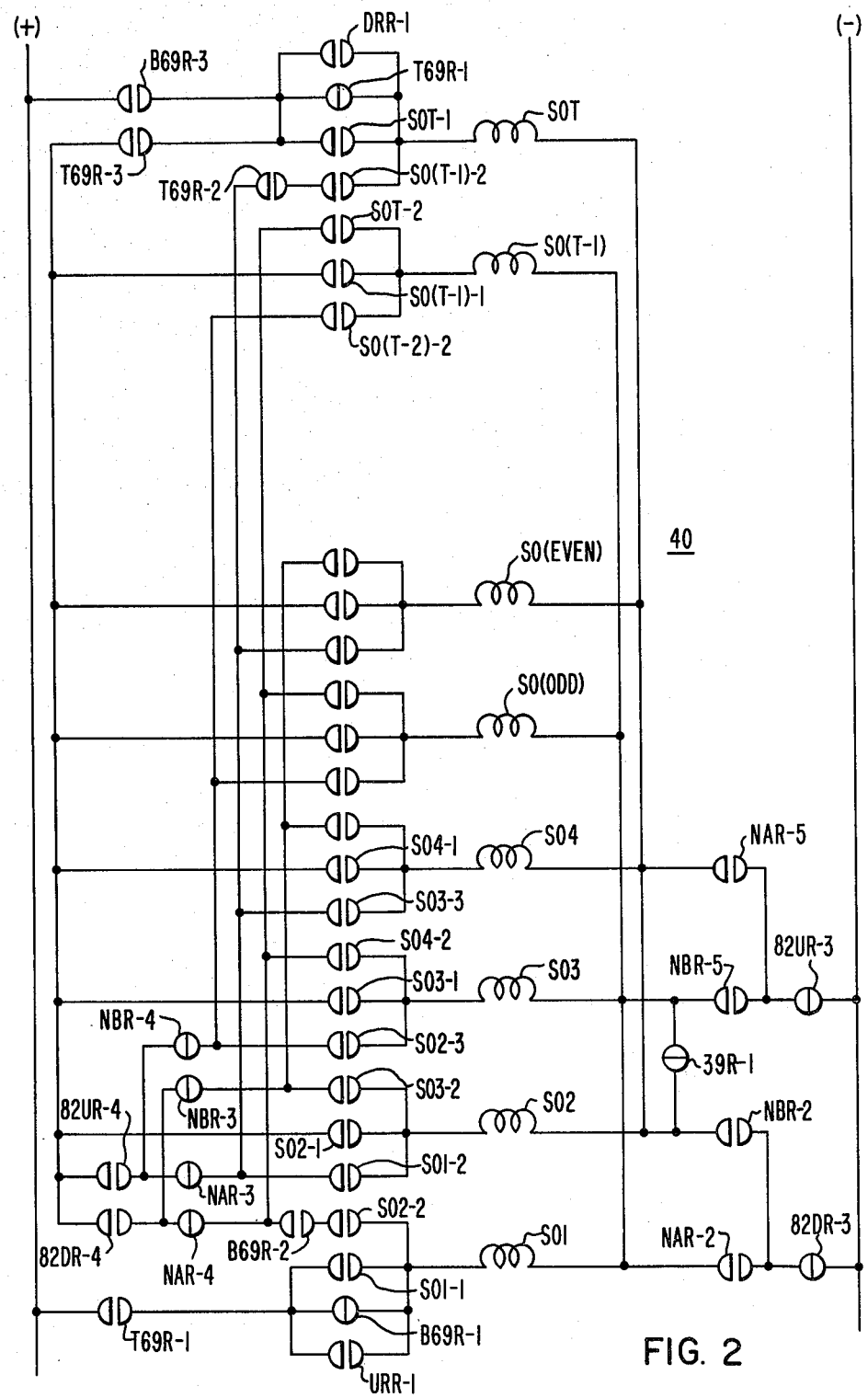
FIG. 2 is a schematic diagram of a notching floor selector which may be used, illustrating the modifications thereto according to the teachings of the invention.
Figure 3:
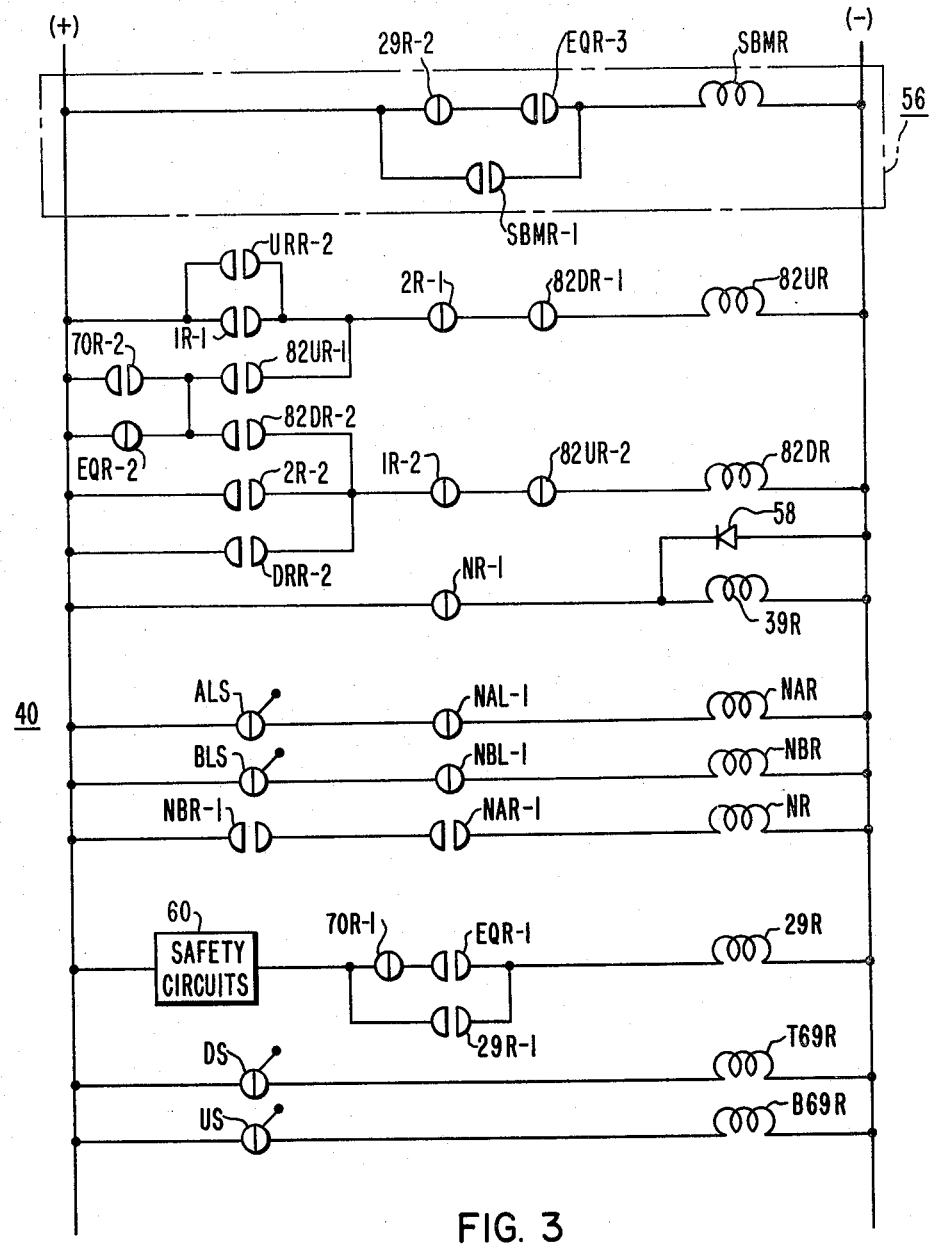
FIG. 3 is a schematic diagram of certain floor selector control for providing signals utilized by the floor selector shown in FIG. 2, and additionally illustrating certain modifications thereto according to the teachings of the invention.

FIGS. 2 and 3 collectively illustrate a notching floor selector 40 which may be used. FIG. 2 is a schematic diagram which sets forth the basic floor selector 40, including an electromechanical relay for each floor to be served by the elevator car, such as relay SO1 for the first floor 22, relay SO2 for the second floor 24, and relay SOT for the uppermost floor 30.

FIG. 3 is a schematic diagram which illustrates most of the relays of floor selector 40 whose contacts are shown in FIG. 2. The functions of the relays in FIG. 3 will first be described before describing the operation of the basic floor selector 40 shown in FIG. 2. FIGS. 3 and 2 will first be described without the modifications taught by the invention, and then the modifications will be described where appropriate. Electromechanical relays 82UR and 82DR are up and down direction relays, respectively, associated with the floor selector 40. They are responsive to up and down travel direction relays 1R and 2R, respectively (not shown). U.S. Pat. No. 4,092,068, which is assigned to the same assignee as the present application, illustrates typical circuits for controlling relays 1R and 2R. This patent is hereby incorporated into the present application by reference. If the up travel direction relay 1R picks up, its contact 1R-1 closes, energizing the up selector relay 82UR via contacts 2R-1 and 82DR-1. Contact 82UR-1 closes to provide an auxiliary hold-in circuit through contact 70R-2 of a non-interference time relay. Relay 70R is energized during the door non-interference time. Thus, selector 40 retains its last travel direction, at least until the elevator car and hatch doors close. If the down travel direction relay 2R picks up, relay 1R will be de-energized, and contact 2R-2 closes to energize the down selector relay 82DR via contacts 1R-2 and 82UR-2. Contact 82DR-2 also closes to provide the auxiliary hold-in circuit via contact 70R-2 during the door open time.

Relays NAR and NBR are selector notching relays which drop out for a short time during notching in response to the momentary opening of notching switches ALS and BLS, respectively, which are operated by the AL and BL devices 44 and 46 in the hoistway 20 shown in FIG. 1. Relay NR drops out during each notching via contacts NAR-1 and NBR-1. Relay 39R picks up during each notching via contact NR-1, and it has a delayed drop-out by virtue of a diode 58 connected across it.

Relay 29R is a safety relay, also shown in the incorporated U.S. Pat. No. 4,092,068, which is energized during initial start-up when the door non-interference time expires and contact 70R-1 closes, if the contacts in the normal safety circuits 60 are all closed. Contact EQR-1 is added in series with contact 70R-1 by the invention and thus is assumed closed in the present discussion. When relay 29R picks up, it seals in via its contacts 29R-1 to thus by-pass contacts 70R-1 and EQR-1.

Relays T69R and B69R are terminal selector synchronizing relays. They are picked up except when the elevator car 12 is located at the uppermost and lowermost floors, respectively. Switches DS and US are actuated to their open conditions by the presence of the elevator car at the upper and lower terminal floors, respectively, as illustrated in FIG. 1.

FIG. 2 illustrates the electromechanical relays of floor selector 40 which represent the various floors of the building. Relays SO1, SO2, SO3 and SO4 represent the first four floors 22, 24, 26 and 28, respectively, relay SOT represents the uppermost floor 30, relay SO (T-1) represents the next to the uppermost floor, relay SO (odd) represents all of the intervening odd floors 34, and relay SO (even) represents all of the intervening even-numbered floors 36.

If the elevator car is located at the lowest floor, contact B69R-1 will be closed, contact T69R-1 will be closed, contact NAR-2 will be closed and since the elevator car 12 will not be set for down travel, contact 82DR-3 will be closed. Thus, relay SO1 will pick up to indicate that the elevator car is at the first floor. Contact SO-1 closes to seal-in around contact B69R-1. Contacts NBR-2 and 39R-1 will also be closed to provide a circuit around the closed contact NAR-2.

When the elevator car moves away from the lowest or first floor 22, relay 82UR will thus be energized, its contact 82UR-3 will be open, and its contact 82UR-4 will be closed. Relay B69R picks up as soon as the car leaves the terminal floor to open its contact B69R-1. Switch ALS will open when the AL indicator 44 is passed, and relay NAR drops for a short time to open its contact NAR-2. Relay SO1 stays energized long enough for relay SO2 to pick up, by virtue of contacts NBR-2 and 39R-1. When relay 39R picks up its contact 39R-1 opens to drop relay SO1. Relay SO2 picks up via contacts 82DR-3, NBR-2, SO1-2, NAR-3, 82UR-4 T69R-3 and B69R-3. It seals in through its contact SO2-1, as contact SO1-2 opens when relay SO1 drops out. If the elevator car continues to travel in the upward direction, the BL indicia 46 will open switch BLS and drop relay NBR. Relay SO3 will pick up via contact 82DR3, NAR-2, SO2-3, NBR-4, 82UR-4, T69R-3 and B69R-3, and relay SO2 will drop out when both contacts NBR-2 and 39R-1 open. The operation for the down travel direction is similar, except contacts 82UR-3, NAR-5 and NBR-5 will be "in control" instead of contacts 82DR-3, NAR-2 and NBR-2, on the righthand side of the electromechanical relays, and contacts 82DR-4, NAR-4 and NBR-3 will be "in control" instead of contacts 82UR-4, NBR-4 and NAR-3 on the lefthand side. When the elevator car 12 reaches the uppermost floor 30, relay T69R will drop out to close its contact T69R-1 and pick up relay SOT via contacts 82UR-3 and either contact NAR-5 or contacts NBR-5 and 39R-1.

The power supply or voltage monitor 56 is shown at the upper portion of FIG. 3. As illustrated, power supply monitor 56 includes a relay SBMR. Relay SBMR picks up when electrical power is initially applied, if the floor selector 40 is properly synchronized, i.e., contact EQR-3 will be closed, as will be hereinafter explained, and relay 29R is still dropped out, i.e., the door non-interference time has not expired. When relay SBMR picks up, it seals in via its contact SBMR-1, and it thus remains energized until the power supply is interrupted or turned off. Once the electrical power is interrupted and returned, relay SBMR will remain deenergized if the floor selector is not in step, as will be hereinafter explained, as contact EQR-3 will be open.

Figure 4:
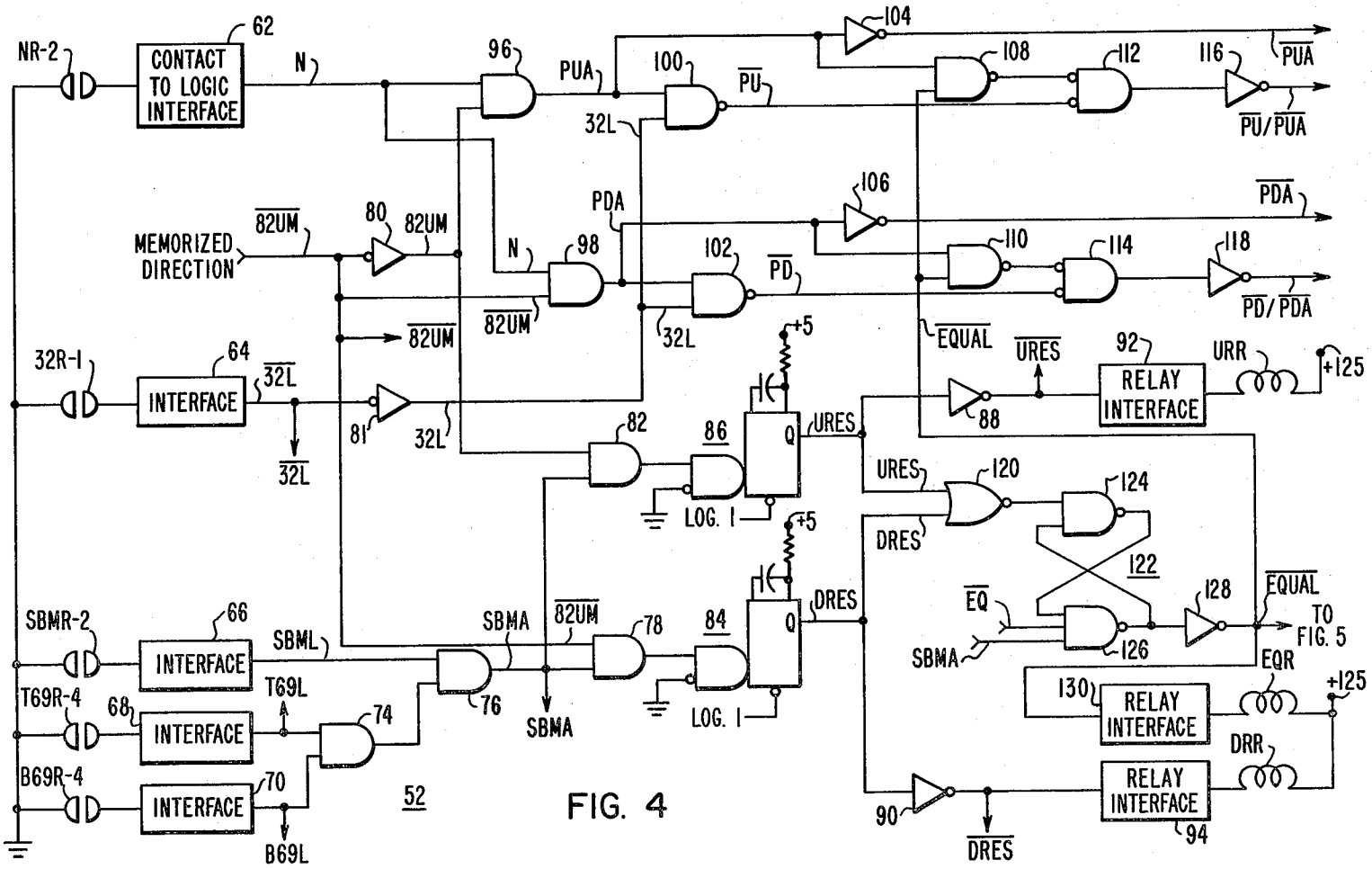
FIG. 4 is a schematic diagram illustrating the development of notching signals, reset signals, out-of-step, and in-step signals, according to the teachings of the invention.
Figure 5:
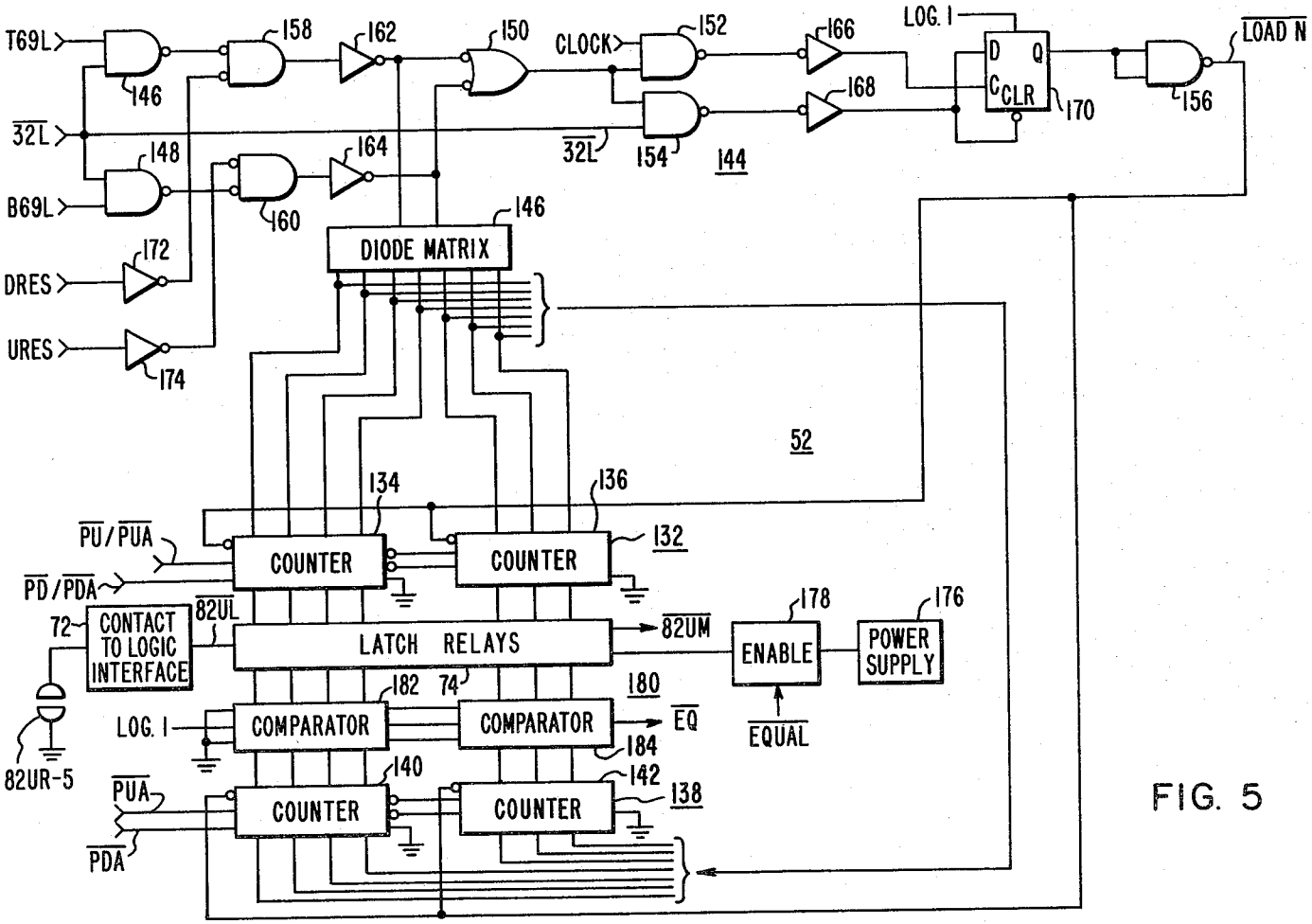
FIG. 5 is a schematic diagram illustrating first and second volatile counters, and a non-volatile memory, constructed according to the teachings of the invention.

FIGS. 4 and 5 collectively illustrate the instep monitor 52 shown in block form in FIG. 1. Certain contacts from the relays hereinbefore described are converted to logic level signals via suitable contact to logic interface circuits. An n.o. contact NR-2 is converted to a logic signal N via interface 62. Relay NR drops during each notching operation to open its contact NR-2. When contact NR-2 is open, logic signal N is a logic one, and when contact NR-2 is closed, logic signal N is a logic zero. N.o. contact 32R-1 is from a running relay 32R (not shown) which picks up when the car doors close at the start of a run, and it drops out when the elevator car 12 stops at the end of the run. Interface 64 converts an open contact 32R-1 to a logic one signal $\overline{32L}$, and a closed contact 32R-1 to a logic zero signal $\overline{32L}$. Thus, logic signal $\overline{32L}$ is low when the elevator car is making a run.

N.o. contact SBMR-2 is associated with relay SBMR in the power supply monitor 56. Interface 66 converts an open contact SBMR-2 to a logic one signal SBML, and a closed contact SBMR-2 to a logic zero signal SBML. Thus, when signal SBML is high, it indicates that the power supply has been interrupted.

N.o. contacts T69R-4 and B69R-4 are converted to logic signals T69L and B69L via suitable interfaces 68 and 70 respectively. A high or logic one signal indicates the elevator car is located at the associated terminal floor.

A n.o. contact 82UR-5 (FIG. 5) from the up selector relay 82UR is applied to an interface 72 to provide a logic one signal $\overline{82UL}$ when contact 82UR-5 is open, and a logic zero signal $\overline{82UL}$ when closed. A latch relay in a plurality of latch relays shown collectively at 74 memorizes the level of signal $\overline{82UL}$ at the time electrical power is interrupted, providing a logic signal $\overline{82UL}$ at the time electrical power is interrupted, providing a logic signal $\overline{82UM}$ which is low when signal $\overline{82UL}$ was low, and a signal $\overline{82UM}$ which is high when signal $\overline{82UL}$ was high.

Returning to FIG. 4, if the elevator car 12 is not located at a terminal floor, signals T69L and B69L will both be a logic one, and an AND gate 74 outputs a logic one to enable a dual input AND gate 76. The other input of AND gate 76 is responsive to signal SBML. Thus, after power is interrupted and returns, signal SBML will be high and AND gate 76 signifies this fact, along with the fact that the elevator car is not located at either terminal floor, by providing a high or true signal SBMA. If the elevator car is located at either terminal floor, gate 76 is blocked, as the floor selector 40 will automatically reset itself when power returns and it is located at a terminal floor.

A true signal SBMA provides a reset signal URES or DRES, depending upon the memorized direction of the floor selector at the time of the power interruption, as provided by signal $\overline{82UM}$. An AND gate 78 is responsive to signals SBMA and $\overline{82UM}$, and an AND gate 82 is responsive to signals SBMA and 82UM, with the latter being provided via an inverter gate 80. The outputs of AND gates 78 and 82 are applied to the inputs of monostable multivibrators 84 and 86, respectively, such as Texas Instruments SN74123. If the memorized direction was up, signal $\overline{82UM}$ will be low and signal 82UM will be high. Thus, AND gate 82 will output a logic one, triggering monostable 86 to provide a logic one pulse URES at its Q output. If the memorized direction was down, signal $\overline{82UM}$ will be high and signal 82UM will be low. Thus, AND gate 78 will output a logic one, triggering monostable 84 to provide a logic one pulse DRES at its Q output. When a logic one pulse URES is provided, a relay URR is momentarily energized via an inverter gate 88 and a logic to relay interface 92. When a logic one pulse DRES is provided, a relay DRR is momentarily energized via an inverter gate 90 and a logic to relay interface 94. A n.o. contact URR-1 from relay URR is connected across n.c. contact B69R-1 in FIG. 2, and a n.o. contact DRR-1 from relay DRR is connected across n.c. contact T69R-1 in FIG. 2. A n.o. contact URR-2 is connected across n.o. contact 1R-1 in FIG. 3, and a n.o. contact DRR-2 is connected across n.o. contact 2R-2 in FIG. 3.

FIG. 4 also illustrates the development of notching pulses for use by certain functions of the instep monitor 52, with these notching or actuating pulses being in synchronism with those which notch the floor selector 40.

The notching pulses are developed in response to contact NR-2 which provides logic signal N. Logic signal N goes high during each notching of the floor selector 40. Signal N is applied to inputs of dual input AND gates 96 and 98, with the memorized direction signal $\overline{82UM}$ being applied directly to the remaining input of AND gate 98, and to the remaining input of AND gate 96 via an inverter gate 80. Thus, when selector 40 is set for the up direction, a pulse PUA is provided each time selector 40 is notched, and when selector 40 is set for the down direction, a pulse PDA is provided each time selector 40 is notched.

It will be noted that pulses PUA and PDA are provided without requiring that the elevator car be moving, as, according to the invention, the re-synchronizing of the selector is accomplished by notching the selector with pseudo or auxiliary notching signals, which are developed without moving the elevator car.

Additional notching signals are provided when the elevator car 12 is moving by dual input NAND gates 100 and 102, with signals PUA and PDA being respectively applied to one of their inputs. Logic signal 32L is applied to their remaining inputs. Thus, when the notching signal PUA is provided while the elevator car 12 is moving, a low or true notching signal $\overline{PU}$ is provided by NAND gate 100, and when notching signal PDA is provided while the elevator car 12 is moving, a low or true notching signal $\overline{PD}$ is provided.

Converter gates 104 and 106 are provided to invert signals PUA and PDA for use by circuitry shown in FIG. 5, with these inverter gates providing signals $\overline{PUA}$ and $\overline{PDA}$, respectively. Normally, signals $\overline{PU}$ and $\overline{PD}$ are associated with a first counting function, and signals $\overline{PUA}$ and $\overline{PDA}$ are associated with a second counting function. However, when selector 40 is out-of-step and it is being resynchronized by the auxiliary notching signals, in a preferred embodiment of the invention, signals $\overline{PUA}$ and $\overline{PDA}$ are also applied to both the first and second counting functions. This is accomplished via NAND gates 108 and 110, NOR gates 112 and 114, and inverter gates 116 and 118. Signals PUA and PDA are applied to inputs of NAND gates 108 and 110, respectively, and a signal $\overline{EQUAL}$ is applied to their remaining inputs. The signal $\overline{EQUAL}$, the development of which will be hereinafter explained, is high when the floor selector 40 is out-of-step, enabling NAND gates 108 and 110. The outputs of NAND gates 108 and 110 are applied to inputs of NOR gates 112 and 114, respectively, and signals $\overline{PU}$ and $\overline{PD}$ are applied to the remaining inputs of NOR gates 112 and 114, respectively. Thus, if either signal $\overline{PUA}$ or $\overline{PU}$ is true, the output of NOR gate 112 will go high, which is inverted to a true signal $\overline{PU/PUA}$ by inverter gate 116. In like manner, if either signal $\overline{PDA}$ or $\overline{PD}$ is true, the output of NOR gate 114 will go high and inverter 118 will provide a low or true signal $\overline{PD/PDA}$.

FIG. 4 is completed by a memory function which includes a NOR gate 120, a flip flop 122, which may be formed of cross-coupled NAND gates 124 and 126, and an inverter gate 128. The output of NOR gate 120 is normally high, because both reset signals are normally low. If either reset pulse URES or DRES is provided, however, the output of NOR gate 120 will go low. If selector 40 is out-of-step, a signal $\overline{EQ}$ will be high, the development of which will be hereinafter explained. If there has been a power interruption and the elevator car is not located at a terminal floor, signal SBMA from AND gate 76 will be high. Under these conditions, when a reset signal URES or DRES is provided, flip flop 122 will be set and inverter 128 will provide a high signal $\overline{EQUAL}$, indicating that the selector 40 is out-of-step. Signal $\overline{EQUAL}$ is applied to the inputs of NAND gates 108 and 110, as previously described. Signal $\overline{EQUAL}$ is also applied to a relay interface 130 which controls an electromechanical relay EQR. When selector 40 is out-of-step and signal $\overline{EQUAL}$ is high, relay EQR will be deenergized. Relay EQR has a n.o. contact EQR-1 connected in series with the safety relay 29R and n.c. contact 70R-1 in FIG. 3, and a n.c. contact EQR-2 which shunts n.o. contact 70R-2 in FIG. 3. When the selector 40 is once again in step, signal $\overline{EQ}$ will go low, resetting flip flop 122, signal $\overline{EQUAL}$ will go low, and relay EQR will pick up.

Referring now to FIG. 5, the in-step monitor 52 includes a first volatile counting function 132, such as formed by a pair of Texas Instruments SN74193, referenced 134 and 136, and a second volatile counting function 138, which may include counters 140 and 142, similar to counters 134 and 136. The first counting function 132 is actuated by notching signals $\overline{PU/PUA}$, or $\overline{PD/PDA}$, and the second counting function is actuated by signals $\overline{PUA}$ and $\overline{PDA}$. Signals $\overline{PU/PUA}$ and $\overline{PUA}$ are applied to the "count up" inputs of the counters, and signals $\overline{PD/PDA}$ and $\overline{PDA}$ are applied to their "count down" inputs.

When selector 40 is in step with actual car position, counter 132 is incremented, or decremented, only in response to the notching pulses generated in response to car movement, ensuring that the count in counter 132 follows the floor selector 40. While counter 138 is incremented, or decremented, by the notching pulses without regard to car movement, it would also be suitable to apply the $\overline{PU/PUA}$ and $\overline{PD/PDA}$ signals to counter 138.

When the elevator car 12 is located at a terminal floor, the correct binary count or binary address of the associated terminal floor is automatically loaded into both counting functions 132 and 138 via a reset function 144 which provides the correct count for the jam input of counting functions 132 and 138 via a diode matrix 146, or other suitable device. A low or true load signal $\overline{\text{LOADN}}$ is provided for the load inputs of the counting functions, which loads the count selected from the diode matrix into the counters. This reset function may include NAND gates 146, 148, 150, 152, 154 and 156, NOR gates 158 and 160, inverter gates 162, 164, 166 and 168, and a D-type flip flop 170.

If the elevator car 12 is stopped at the upper terminal floor, for example, the output of NAND gate 146 will go low, the output of NOR gate 158 will go high, and inverter 162 will apply a low signal to NAND gate 150. The low output of inverter gate 162 also selects the address of the upper terminal floor in matrix 146. NAND gate 150 will thus output a logic one and NAND gate 152 outputs a logic zero in synchronism with a clock pulse CLOCK developed in FIG. 6. Inverter 166 will then apply a logic one to the clock input flip flop 170. If the elevator car is not moving when the output of NAND gate 150 goes high, NAND gate 154 and inverter 168 cooperate to provide a logic one for the D-input of flip flop 170, which is clocked to the Q output and inverted by NAND gate 156 to a low or true load signal $\overline{\text{LOADN}}$.

If the elevator car is stopped at the lower terminal floor, NAND gate 148, NOR gate 160 and inverter gate 164 select the address of the lower terminal floor in diode matrix 146, and they also cooperate to cause the output of NAND gate 150 to go high, which results in a low signal $\overline{\text{LOADN}}$ being generated, as just described.

A true load signal and the selection of the proper terminal address in matrix 146 is also provided when a true reset signal URES or DRES is provided. Signal DRES is inverted by an inverter gate 172 and applied to an input of NOR gate 158, and signal URES is inverted by an inverter gate 174 and applied to an input of NOR gate 160.

The count on counter 132 is memorized by suitable latch relays 74, as is the selector direction via contact 82UR-5, as hereinbefore explained. The plurality of latch relays 74 may be constructed as shown in the incorporated patent, or any other suitable latch relay may be used. The latch relays 74 provide a count which follows the count of counter 132 until electrical power fails. The latch relays 74 then hold this latest count, and the memorized selector direction, until the selector 40 is once again in step with the actual position of the elevator car. This may be accomplished by connecting a power supply 176 to the latch relays 74 via a suitable enabling function 178, with the enabling function 178 being responsive to the signal $\overline{\text{EQUAL}}$, as shown, or responsive to a contact from relay EQR.

The output or count of the latch relays 74 is continuously compared with the count of the second counting function 138 by a comparator function 180, with the latter function being provided, for example, by a pair of Texas Instruments SN7485, referenced 182 and 184. Comparator 180 provides a low or true signal $\overline{\text{EQ}}$ when counting function 138 is in-step with the memorized position or count provided by latch relays 74. If the power supply 41 should be interrupted, the latch relays 74 will hold the latest count and the selector direction, but the count held by counter 138, being volatile, will change. Thus, when power returns, signal $\overline{\text{EQ}}$ will be high, indicating an out-of-step condition.

Figure 6:
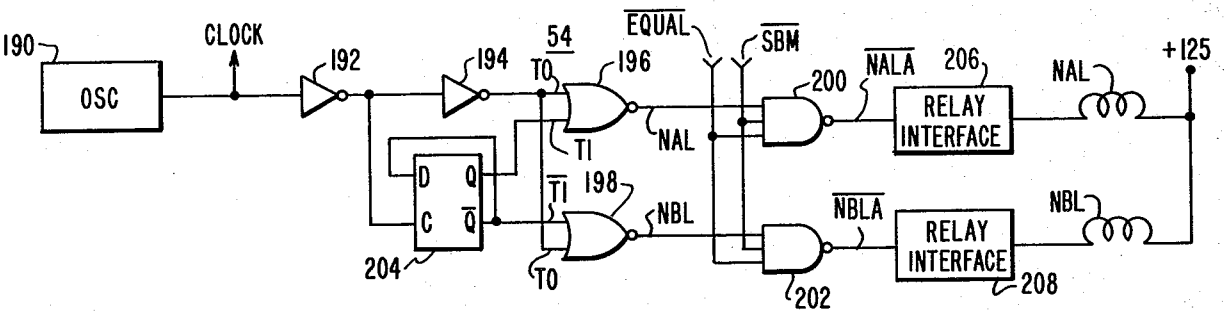
FIG. 6 is a schematic diagram of apparatus for developing auxiliary notching signals, according to the teachings of the invention.

FIG. 6 illustrates the auxiliary notching function 54, which includes an oscillator or clock 190 which provides the signal CLOCK, inverter gates 192 and 194, NOR gates 196 and 198, NAND gates 200 and 202, a D-type flip-flop 204, logic-to-relay interfaces 206 and 208, and relays NAL and NBL. Relays NAL and NBL have n.c. contacts NAL-1 and NBL-1 connected in series with relays NAR and NBR shown in FIG. 3. Thus, relays NAR and NBR, in addition to being responsive to the notching cams and switchs AL and BL, are controlled by the auxiliary notching circuit 54.

Figure 7:
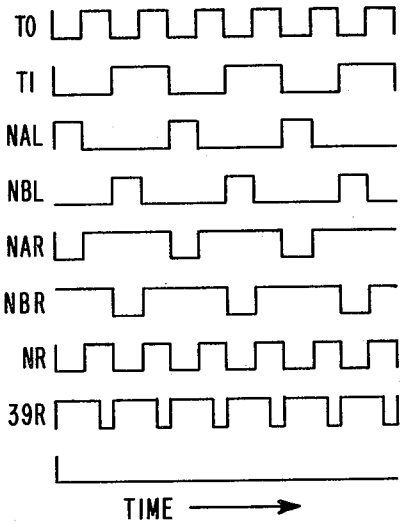
FIG. 7 is a graph which sets forth certain related signals useful in understanding the invention, including the auxiliary notching signals generated by the apparatus of FIG. 6.

When signal $\overline{\text{EQUAL}}$ and $\overline{\text{SBM}}$ are both high, indicating a prior power supply interruption and out-of-step condition. NAND gates 200 and 202 are enabled to pass auxiliary notching signals to the relay interfaces 206 and 208, respectively. The auxiliary notching pulses are responsive to a signal T0, provided by clock 190 and inverters 192 and 194, and signals T1 and $\overline{\text{T1}}$ developed by flip-flop 204 in response to the output of inverter gate 192. Signals T0 and T1, which are illustrated graphically in FIG. 7, are applied to inputs of NOR gate 196. Signal T0 and a signal which may be called $\overline{\text{T1}}$ are applied to inputs of NOR gate 198. The output of NOR gate 196, referenced NAL in FIG. 7, goes high each time signals T0 and $\overline{\text{T1}}$ are both low, and the output of NOR gate 198 goes high each time signals T0 and T1 are both low. Each time signal NAL goes high, the output $\overline{\text{NALA}}$ of NAND gate 200 goes low to energize relay NAL and open its contact NAL-1. This drops relays NAR and NR, which are illustrated graphically in FIG. 7. In like manner, each time signal NBL goes high, the output $\overline{\text{NBLA}}$ of NAND gate 202 goes low to energize relay NBL and open its contact NBL-1. This drops relays NBR and NR, as illustrated in FIG. 7. Contact NR-2 of relay NR in FIG. 4 initiates the development of the up and down pulses for the counters of FIG. 5, as hereinbefore explained.

In operation, when there has been a power interruption and the elevator 12 is not located at a terminal floor, relays SBMR, 29R and EQR will drop out, and when power returns they will remain in the de-energized condition. Signal SBMA, which will be high if the power interruption occurred when the elevator car was not located at a terminal floor, and the memorized direction signal $\overline{\text{82UM}}$ cooperate as shown in FIG. 4 to provide a reset pulse URES when the selector 40 was set for the up direction, and a reset pulse DRES when the selector 40 was set for the down direction. Either relay URR or DRR, shown in FIG. 4, will be momentarily energized to close contact URR-2 or contact DRR-2, shown in FIG. 3, to pick up the up direction selector relay 82UR, or the down direction selector relay 82DR, which then properly set their associated contacts in the floor selector 40 shown in FIG. 2. The closed contact EQR-2 seals in the selected relay 82UR or 82DR. Contacts DRR-1 or URR-1 close to reset the floor selector 40 shown in FIG. 2 to the upper or lower terminal floor, respectively. Reset pulse URES or reset pulses DRES also resets both counters 132 and 138 to the proper terminal floor address.

Signals $\overline{\text{EQUAL}}$ and $\overline{\text{SBM}}$ start the generation of the auxiliary notching signals, as shown in FIG. 6, and counters 132 and 138 count up, or down, in synchronism with the notching of floor selector 40. When counter 138 reaches the count of the latch relays 74, signal $\overline{EQ}$ goes low, resetting flip-flop 122. Signal $\overline{EQUAL}$ goes low blocking the generation of the auxiliary notching signals, and relay EQR picks up to close contact EQR-1 and enable the safety relay 29 in FIG. 3 to pick up when the door non-interference time expires. Contact EQR-3 also closes to pick up relay SBMR, while relay 29R is still de-energized, and relay SBMR then seals in via its contact SBMR-1. The elevator system is now re-synchronized and ready for operation.

We claim as our invention:

1. An elevator system, comprising:

a building having a plurality of floors, an elevator car mounted for movement in a predetermined travel path in said building to serve the floors therein, a notching floor selector including a memory element for each floor served by said elevator car, a power supply for said floor selector, first and second volatile counter means, non-volatile memory means responsive to and memorizing the count of said first counter means, means notching said floor selector and actuating said first and second counter means in response to movement of said elevator car such that said counter means have a count representative of the floor registered in said floor selector, comparator means comparing the memorized count in said non-volatile memory means with the count of said second counter means, said comparator means providing a first signal when the counts match and a second signal when they do not, and reset means resetting said notching floor selector and at least said second counter means to each represent the same floor at a selected end of the predetermined travel path of said elevator car, in response to said comparator means providing its second signal, said reset means including auxiliary notching means notching said notching floor selector and actuating said second counter means in a predetermined direction, without movement of the elevator car following reset by said reset means, until said comparator means provides its first signal, indicating that said notching floor selector and said second counter means have been notched and actuated, respectively, to represent the floor memorized by said non-volatile memory means.

2. The elevator system of claim 1 wherein the memory elements of the notching floor selector are electromechanical relays.

3. The elevator system of claim 2 wherein the first and second volatile counters are binary counters.

4. The elevator system of claim 1 wherein the non-volatile memory means includes latch relays which retain their last positions during power interruption to define a count indicative of the floor registered in the notching floor selector at the time of power interruption.

5. The elevator system of claim 4 including means for causing said latch relays to retain its count at the time of power supply interruption, following return of power, notwithstanding a changed count in the first counter means, at least until the memorized count has been used to reset the notching floor selector and second counter means.

6. The elevator system of claim 1 wherein the reset means also resets and actuates the first counter means simultaneously with the resetting, notching and actuating of the notching floor selector and second counter means.

7. The elevator system of claim 1 wherein the non-volatile memory means also includes means for memorizing the travel direction of the elevator car at the time of an interruption in the power supply, with the reset means resetting the notching floor selector and second counter means to represent the lowest floor in the travel path of the elevator car when the memorized travel direction is up, and the highest floor in the travel path when the memorized direction is down, and wherein the predetermined notching and actuating directions of the notching floor selector and second counter means is up when they have been reset to represent said lowest floor, and down when they have been reset to represent said highest floor.

8. The elevator system of claim 1 including power supply monitoring means responsive to the power supply, said power supply monitoring means providing a first signal until the power supply has been interrupted, and a second signal thereafter, and wherein the reset means requires both the comparator means and the power supply means to provide their second signals before resetting the notching floor selector and said second counter means.

* * * * *